United States Patent [19]

Berman

[11] Patent Number: 4,907,359

[45] Date of Patent: Mar. 13, 1990

[54] KEY IDENTIFICATION TAG

[75] Inventor: Sidney A. Berman, Woodland Hills, Calif.

[73] Assignee: Law Printing Company, Inc., Los Angeles, Calif.

[21] Appl. No.: 136,752

[22] Filed: Dec. 22, 1987

[51] Int. Cl.[4] ..... A44C 3/18

[52] U.S. Cl. ..... 40/299; 40/330; 40/645

[58] Field of Search ..... 40/645, 299, 330, 633, 40/662, 615, 662

[56] References Cited

U.S. PATENT DOCUMENTS

| | | | |
|---|---|---|---|
| 2,979,840 | 4/1961 | Eastman | 40/299 |
| 3,153,868 | 10/1964 | Jones | 40/299 |
| 4,159,586 | 7/1979 | Blum | 40/299 |
| 4,204,706 | 5/1980 | Blum | 40/299 |

*Primary Examiner*—Kenneth J. Dorner

*Assistant Examiner*—Wenceslao J. Contreras

[57] ABSTRACT

An identification tag for handwritten imprinting of information is disclosed. In such an application, a hole is provided for attachment to the identified item by a variety of conventional means. A transparent protective sheet is attached to the tag in the area of the hole by a pressure sensitive adhesive. The balance of the protective sheet is coated with the adhesive but isolated from the tag by a releasable backing. Following information imprinting, the backing is removed to allow the adhesive to completely attach the protective sheet to the tag. The imprinted tag may be temporarily attached to another object by an extension of the protective sheet, adhesive, and backing beyond an edge of the tag. Subsequent removal of the tag is accomplished by bending and tearing along perforations or scoring in the protective sheet at the edge of the tag. Various embodiments and applications of the tag are disclosed.

3 Claims, 1 Drawing Sheet

KEY IDENTIFICATION TAG

BACKGROUND OF THE INVENTION

1. Field of the Invention.

The present invention relates to the field of permanent handwritten or otherwise rapid identification of a key's or keyset's application by means of an attached tag.

2. Description of the Prior Art.

In certain applications, it is required, or at least desirable, to know the purpose for which keys or other items are intended by attaching an identification tag. The most common technique is a plain paper tag with an attaching spring wire ring through a grommet reinforced hole in the tag. Other attaching means are employed, but the paper tag with a hole, and usually a reinforcing grommet, remain constant. A clear plastic sheath can also be employed. It covers the back of the tag, folds at the side of the tag to cover the front and folds again at the other side, overlapping a small portion of the back. The wire ring, or other attaching means, is sufficiently large to allow the sheath to be opened for writing on the tag while still engaging the holes in the tag and the front and back of the sheath.

Various other types of identification tags are well known in the prior art. By way of example, U.S. Pat. No. 4,492,048 discloses a system comprised of individually stored components. Clear protector strips are stored on a backing sheet by means of an adhesive. A separate attachment member engages the item to be identified and the identification tag. The clear protector strip permanently joins the identified item, the attachment member and the tag. The areas to be improved upon in this prior art are: inconvenience and additional cost to manufacture three separate components, and required destruction of the tag for otherwise temporary removal for purposes such as duplicating a key.

SUMMARY OF THE INVENTION

The present invention optimizes all aspects of an identification tag system avoiding numerous shortcomings of prior proposals by so constructing a unique combination of three simple elements. A clear plastic sheet, coated with adhesive, is isolated from the tag by a backing sheet except at one end. That end of the sheet is affixed to the tag of similar perimeter. A hole penetrates the sheet and the tag in the adhesive bonded zone to engage the spring wire ring. After imprinting the tag, the backing is removed and the balance of the sheet affixed to the tag.

Accordingly, it is a primary object of this invention to provide an improved identification tag constructed and arranged to allow easy data entry with an inexpensive system that is attractive, durable and water resistant.

Another object of the invention is the provision for proper alignment of the protective sheet with the tag and elimination of risk of misplacing either element by prior assembly. The portion of the sheet affixed to the tag also provides a means to easily remove the backing by bending the sheet back on that area to initiate separation.

Another object of the invention is the provision for elimination of a grommet to reinforce the paper tag where it engages the attaching means by the additional strength lent by lamination with the protective plastic sheet. The present invention eliminates up to two additional layers of the plastic sheath with its inferior moisture resistance and added bulk.

Another object of the invention is the provision for efficient assembly of an inexpensive variety of materials with readily available automated equipment by the unique arrangement of components. The tag can be preprinted from roll laminated between rollers with backed cover sheet from roll after the laminating edge is continuously stripped to a to a takeup roll, hole punched, wire ring formed in the hole and finally sheared from web.

Another object of the invention is to provide an optional means of temporarily attaching the identification tag to another object such as a form, folder or key board. The provision is accomplished by extending the cover and its backing beyond the writing surface and scoring or perforating it at that edge. The tag is then attached at the time the backing is removed and later separated by bending at the perforation and tearing away.

Another object of the invention is the provision for temporarily releasing the item identified for activity such as duplicating a key.

These and other more specific objects will appear upon reading the following specification and claims and upon considering in connection therewith the attached drawing to which they relate.

DETAILED DESCRIPTION OF THE INVENTION

Figure 2:
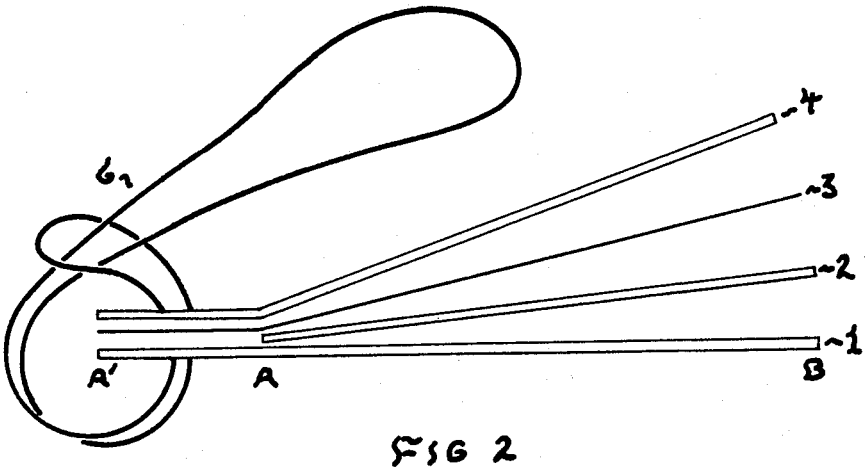
FIG. 2 is a profile of the assembly illustrating the order and location of elements with a continuous cord to replace the ring as the attaching means.

Referring initially to FIG. 2, a preferred embodiment of the present invention can be seen where zone A—A' of tag 1 is fixed to the cover sheet 4 by pressure sensitive adhesive layer 3. Tag 1 may be composed of any rigid or semi rigid material suitable for machine imprinting prior to assembly and by hand imprinting following assembly either on the top or both top and bottom sides illustrated. Pressure sensitive adhesive layer 3 represents any of the common variety of thin, transparent materials used to join paper and plastic goods. Cover sheet 4 is a flexible transparent or translucent element that can be embellished with color or pattern in areas that would not prohibit viewing information imprinted on the tag. Any embellishments would be for the purposes of enhancing appearance or color coding tag applications.

Referring again to FIG. 2, an additional preferred embodiment of the present invention can be seen where backing sheet 2 is so positioned to temporarily protect the writing surface of the tag 1 from adhesive 3. Backing sheet 2 must be composed of a material on the side facing cover sheet 4 that will allow complete separation from adhesive layer 3 after the tag is imprinted. By virtue of the requirement for backing sheet 3 only until lamination of cover to tag, it can be seen that both sides of the backing sheet are ideally suited for imprinting with temporary information such as instructions for use or operation.

Figure 1:
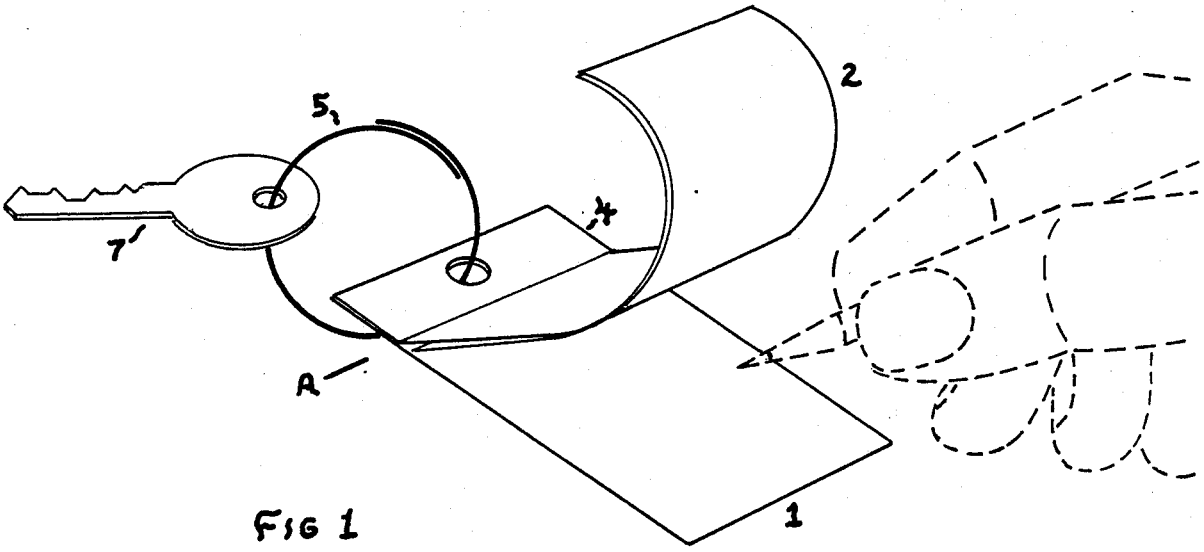
FIG. 1 is a perspective view illustrating the tag being manually imprinted, the key and tag engaged by the ring and separation of the backing initiated by the in the protective sheet.
Figure 3:
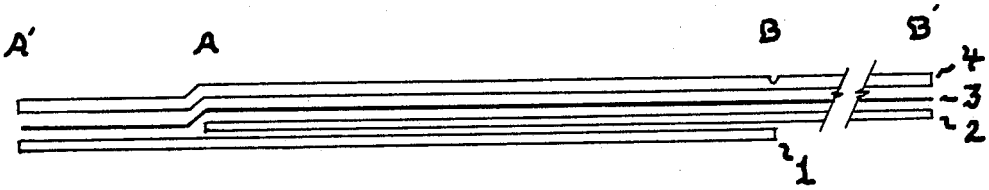
FIG. 3 is a profile of the assembly illustrating the cover sheet with backing extended beyond the tag for the purpose of attachment to another surface or to wrap around to cover the back of the tag.

Referring now to FIGS. 1, 2 and 3, there is shown a hole through the assembly in the middle of both axis of zone A'-A. The purpose of the hole is to engage an attaching element such as spring wire ring 5 or flexible endless cord looped as item 6.

Additionally and importantly, cover sheet 4, adhesive layer 3 and backing 2 are optionally extended beyond the tag as illustrated in FIG. 3 from B to B'. Cover sheet 4 is scored or perforated across its width at B to allow bending the cover sheet around to cover the back of the tag or to allow the tag to be torn from zone B'-B which is fixed to another object for temporary storage of the completed tag.

It is to be understood that while I have shown and described a certain embodiment of the present invention with reference to identification of items such as automobile, house or hotel room keys, that the same features can be applied with equal vitality to other identification tags. For example, the cord 6 illustrated in FIG. 2 ideally accommodates attachment of the tag to a baggage handle. Other examples of implementing the present invention may reside in identification of production dates, lot numbers, or inspector of high volume commercial products or the like. Thus while the preferred embodiment of the invention has been disclosed and described with respect to key identification, it will be understood by those skilled in the art that various changes in form and detail as well as application may be made therein without departing from the spirit and scope of the invention.

I claim:

1. An identification tag comprising:
- a tag having a surface suitable for imprinting;
- a flexible, transparent protective sheet that exceeds the tag's dimensions in one axis;
- a transparent adhesive means that completely engages a surface of said protective sheet and receives a portion of one edge of said tag;
- a backing means releasably attached by said adhesive to said protective sheet except in the area received by said portion of one edge of said tag.

2. An identification tag as described in claim 1 wherein: said received portion's center of said protective sheet and tag is penetrated by a hole.

3. An identification tag as described in claim 1 wherein: the portion of said protective sheet is scored along the edge where it exceeds said tag to assist in bending or separation of said protective sheet.

* * * * *